US007950648B2

(12) United States Patent
Asakawa et al.

(10) Patent No.: US 7,950,648 B2
(45) Date of Patent: May 31, 2011

(54) FEEDING DEVICE AND IMAGE FORMING APPARATUS

(75) Inventors: Masaya Asakawa, Yamatokoriyama (JP); Masahiko Fujita, Nara (JP); Tadasu Taniguchi, Uda (JP); Masatsugu Ohishi, Nara (JP); Masaharu Kimura, Daito (JP); Yasuaki Fukada, Nara (JP); Norichika Katsura, Tenri (JP); Yasuhiro Takai, Sakurai (JP)

(73) Assignee: Sharp Kabushiki Kaisha, Osaka (JP)

( * ) Notice: Subject to any disclaimer, the term of this patent is extended or adjusted under 35 U.S.C. 154(b) by 337 days.

(21) Appl. No.: 12/027,802

(22) Filed: Feb. 7, 2008

(65) Prior Publication Data

US 2008/0197561 A1 Aug. 21, 2008

(30) Foreign Application Priority Data

Feb. 15, 2007 (JP) ..... 2007-034854

(51) Int. Cl.
*B65H 3/44* (2006.01)

(52) U.S. Cl. ..... 271/9.08; 271/9.07; 271/9.11; 271/162

(58) Field of Classification Search ..... 271/9.11, 271/9.08, 162, 9.01, 9.07
See application file for complete search history.

(56) References Cited

U.S. PATENT DOCUMENTS

| | | | | |
|---|---|---|---|---|
| 4,168,058 | A * | 9/1979 | Granzow et al. | 271/5 |
| 4,196,898 | A * | 4/1980 | Misawa et al. | 271/9.08 |
| 5,224,693 | A * | 7/1993 | Taguchi et al. | 271/9.11 |
| 7,403,739 | B2 * | 7/2008 | Hwang | 399/391 |

FOREIGN PATENT DOCUMENTS

| | | | |
|---|---|---|---|
| JP | 61-127531 | | 6/1986 |
| JP | 61188336 | A * | 8/1986 |
| JP | 61-277525 | A | 12/1986 |
| JP | 3-18042 | U | 2/1991 |
| JP | 03259824 | A * | 11/1991 |
| JP | 10-194486 | | 7/1998 |
| JP | 2001-301994 | A | 10/2001 |
| JP | 2002-060064 | | 2/2002 |

* cited by examiner

*Primary Examiner* — Stefanos Karmis
*Assistant Examiner* — Luis A Gonzalez
(74) *Attorney, Agent, or Firm* — Nixon & Vanderhye, PC

(57) ABSTRACT

A feeding device according to the present invention includes a box, paper holders, and a shifting mechanism. The box is open at its top. The paper holders are open at their tops and positioned in the box. Each of the paper holders holds a pile of sheets of paper in it. The shifting mechanism so shifts at least one of the paper holders that the top sheet in one of the paper holders is positioned in a single feed position in the box according to selection data output from the apparatus with which the feeding device is used.

14 Claims, 7 Drawing Sheets

FEEDING DEVICE AND IMAGE FORMING APPARATUS

CROSS REFERENCE

This Nonprovisional application claims priority under 35 U.S.C. §119(a) on Patent Application No. 2007-034854 filed in Japan on Feb. 15, 2007, the entire contents of which are hereby incorporated by reference.

BACKGROUND OF THE TECHNOLOGY

The present technology relates to a feeding device for use with an apparatus including a processing station for processing the sheets of paper (recording media) fed from the device. The technology also relates to an image forming apparatus fitted with such a feeding device.

An image forming apparatus or another apparatus for processing sheets of paper is fitted with a feed cassette for holding a large number of sheets of paper. Some types of such apparatus are fitted with two or more feed cassettes for holding sheets of paper different in quality or size.

In view of operability, many types of image forming apparatus have a front access structure enabling the apparatus to be operated by an operator in front of it. A buildup system is used in an image forming apparatus having a front access structure. The buildup system includes feed cassettes, the number of which is based on the operators' needs. The cassettes are fitted in the bottom of the apparatus. An image forming apparatus which has a front access structure and in which a buildup system is used tends to be high. This makes it difficult to handle a document at the document reading station positioned at the top of the apparatus. As a result, the operability of the apparatus decreases.

For higher operability, it is proposed to hold different types of paper in one feed cassette. As an example, JP-H10-194486A discloses an image forming apparatus fitted with two feed cassettes. One of the cassettes holds the largest sheets of paper which can be processed by the apparatus. The other cassette has two holding spaces formed in parallel in it, from each of which smaller sheets of paper can be fed. For the two holding spaces, it is necessary to provide two feed passages and two feed mechanisms (feed rollers etc.). This complicates the feed passage arrangement in the apparatus, resulting in the apparatus being large in size.

As another example, JP-2002-60064A discloses an image recorder having a first holding space and a second holding space which are formed in it. The two holding spaces hold sheets of paper of a type. Sheets of paper can be fed only from the first holding space. When the first holding space becomes empty, the sheets in the second holding space are shifted to that space. The shifting makes the bottom sheet of paper liable to wrinkle or tear. There is a high possibility that lower sheets of paper are moved obliquely from the second holding space to the first holding space, so that the paper feedability of the recorder is low. These make paper jams liable to occur in the recorder.

SUMMARY OF THE TECHNOLOGY

An object of the present technology is to provide a feed cassette which makes it possible to selectively feed different types of paper from a single feed position in the cassette without enlarging the apparatus with which the cassette is used, and without reducing the paper feedability of the apparatus.

Another object is to provide an image forming apparatus fitted with such a feed cassette.

A feed cassette includes a box, paper holders, and a shifting mechanism. The box is open at its top. The paper holders are open at their tops and positioned in the box. Each of the paper holders holds a pile of sheets of paper in it. The shifting mechanism so shifts at least one of the paper holders that the top sheet in one of the paper holders is positioned in a single feed position in the box according to selection data output from the apparatus with which the feed cassette is used. The top sheet in the paper holder selected according to the selection data is in the feed position. The feed mechanism of the apparatus feeds one or more of the sheets in the selected holder from the feed position.

DETAILED DESCRIPTION OF THE TECHNOLOGY

The best mode of carrying out the present technology will be described below with reference to the accompanying drawings.

Figure 1:
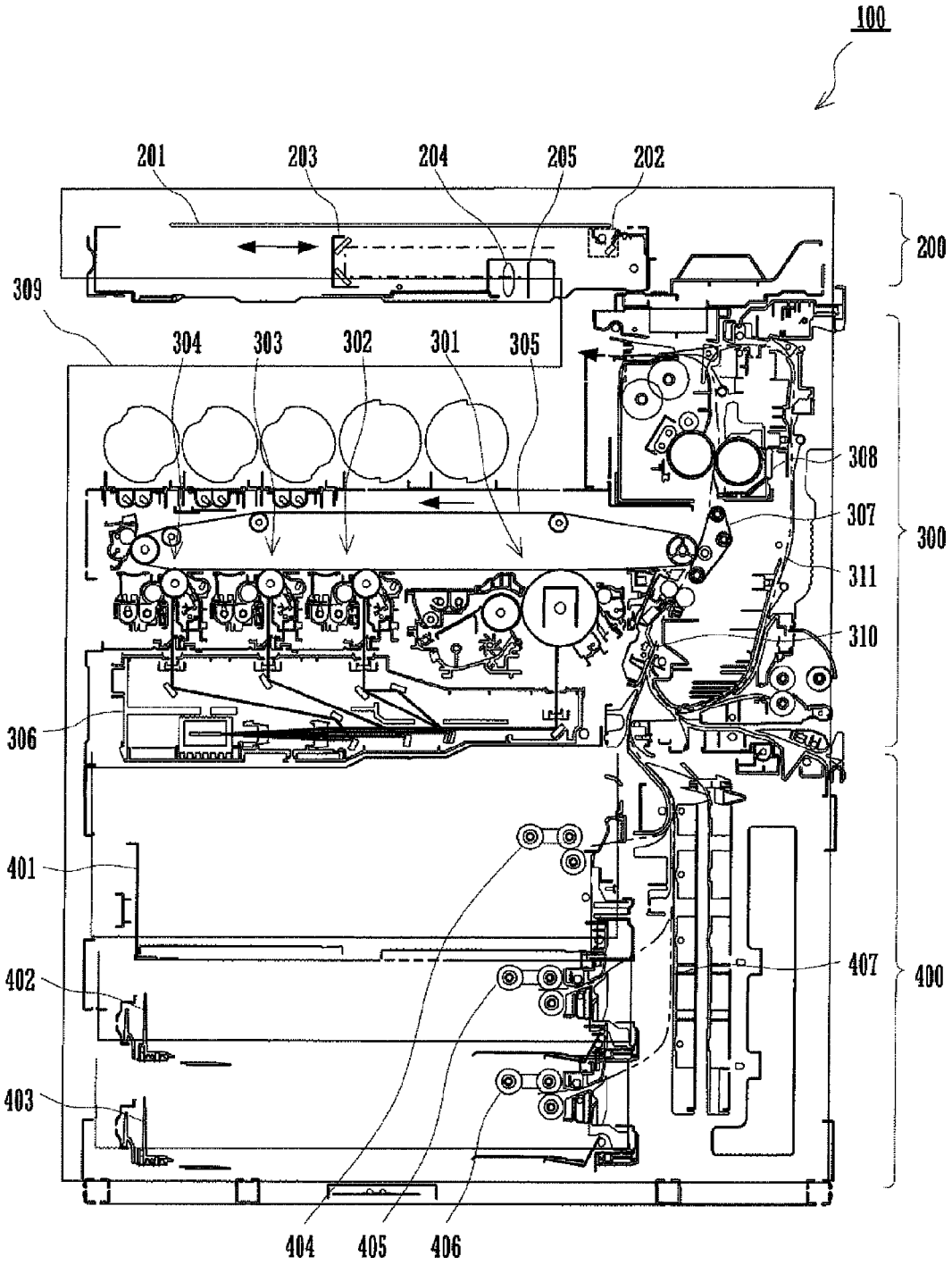
FIG. 1 is a schematic sectional front view of an image forming apparatus.

With reference to FIG. 1, an image forming apparatus 100 includes an image reading station 200, an image recording station 300, and a paper feeding station 400.

The image reading station 200 includes a document platform 201, a first mirror base 202, a second mirror base 203, an imaging lens 204, and a CCD (charge coupled device) 205. The platform 201 is a hard glass plate and supports a document. The mirror bases 202 and 203 can move horizontally under the platform 201. The speed at which the second mirror base 203 moves is ½ of the speed at which the first mirror base 202 moves. The first mirror base 202 carries a light source and a first mirror. The second mirror base 203 carries a second mirror and a third mirror.

The mirror bases 202 and 203 move horizontally under the document platform 201 so that the image on the document on the platform can be read. The light source on the first mirror base 202 radiates light to the under side of the document on the platform 201. The light reflected by the under side of the document is reflected by the first mirror on the first mirror base 202 to the second mirror base 203. The light reflected by the under side of the document is incident on the CCD 205 via the imaging lens 204 by means of the second and third mirrors on the second mirror base 203, with the optical path length kept constant. The CCD 205 outputs an electric signal representing the quantity of light reflected by the under side of the document. The signal is input as image data into the image recording station 300.

The image recording station 300, which corresponds to the processing station, includes process units 301-304, an intermediate transfer belt 305, an exposure unit 306, a secondary transfer belt 307, a fixing unit 308, a delivery tray 309, and paper passages 310 and 311.

The process units 301-304 perform electrophotographic image formation based on monochromatic, cyan, magenta, and yellow image data, respectively, and form monochromatic, cyan, magenta, and yellow toner images, respectively.

The intermediate transfer belt 305 runs over rollers. The toner images formed by the process units 301-304 can be transferred to the belt 305. For color image formation, color toner images formed by the process units 301-304 are transferred to the outer surface of the belt 305 by being superimposed on it. For monochromatic image formation, only a monochromatic toner image formed by the process unit 301 is transferred to the belt surface.

The exposure unit 306 includes semiconductor lasers, a polygon mirror, and an fθ lens which are fitted in it. The exposure unit 306 radiates, to the process units 301-304, laser beams modulated with monochromatic, cyan, magenta, and yellow image data, respectively.

The secondary transfer belt 307 runs over rollers and transfers the toner image on the intermediate transfer belt 305 to a sheet of paper.

The fixing unit 308 includes a pair of fixing rollers. While a sheet of paper with a toner image transferred to it is passing between the fixing rollers, the fixing unit 308 heats and presses the sheet so as to fix the toner image on the sheet.

The delivery tray 309 is positioned over the process units 301-304 and under the image reading station 200 and holds sheets of paper with images formed on them.

The paper passage 310 leads from the bottom of the image forming station 300 through the nip between the transfer belts 305 and 307, and through the fixing unit 308, to the delivery tray 309.

The paper passage 311 leads from the side of the fixing unit 308 which is downstream on the paper passage 310 to the upstream end of the portion of the secondary transfer belt 307 which runs along the passage 310. For double-side image formation, a sheet of paper with an image formed on one side of it is fed with its ends reversed along the passage 311.

The paper feeding station 400 includes feed cassettes 401-403, feed mechanisms 404-406, and a feed passage 407. Each of the cassettes 401-403 holds sheets of paper of a size. The cassette 401, which corresponds to a feed cassette, holds different types of sheets of paper. The feed mechanisms 404-406 feed sheets of paper one after one from the cassettes 401-403 respectively. The feed passage 407 leads from the cassettes 401-403 to the paper passage 310. The cassette 401 is a feeding device.

The paper feeding station 400 selectively drives one of the feed mechanisms 404-406 to feed sheets of paper one after one from the associated cassette 401, 402, or 403. A sheet of paper fed from the feeding station 400 is fed along the feed passage 407 to the paper passage 310.

Figure 2:
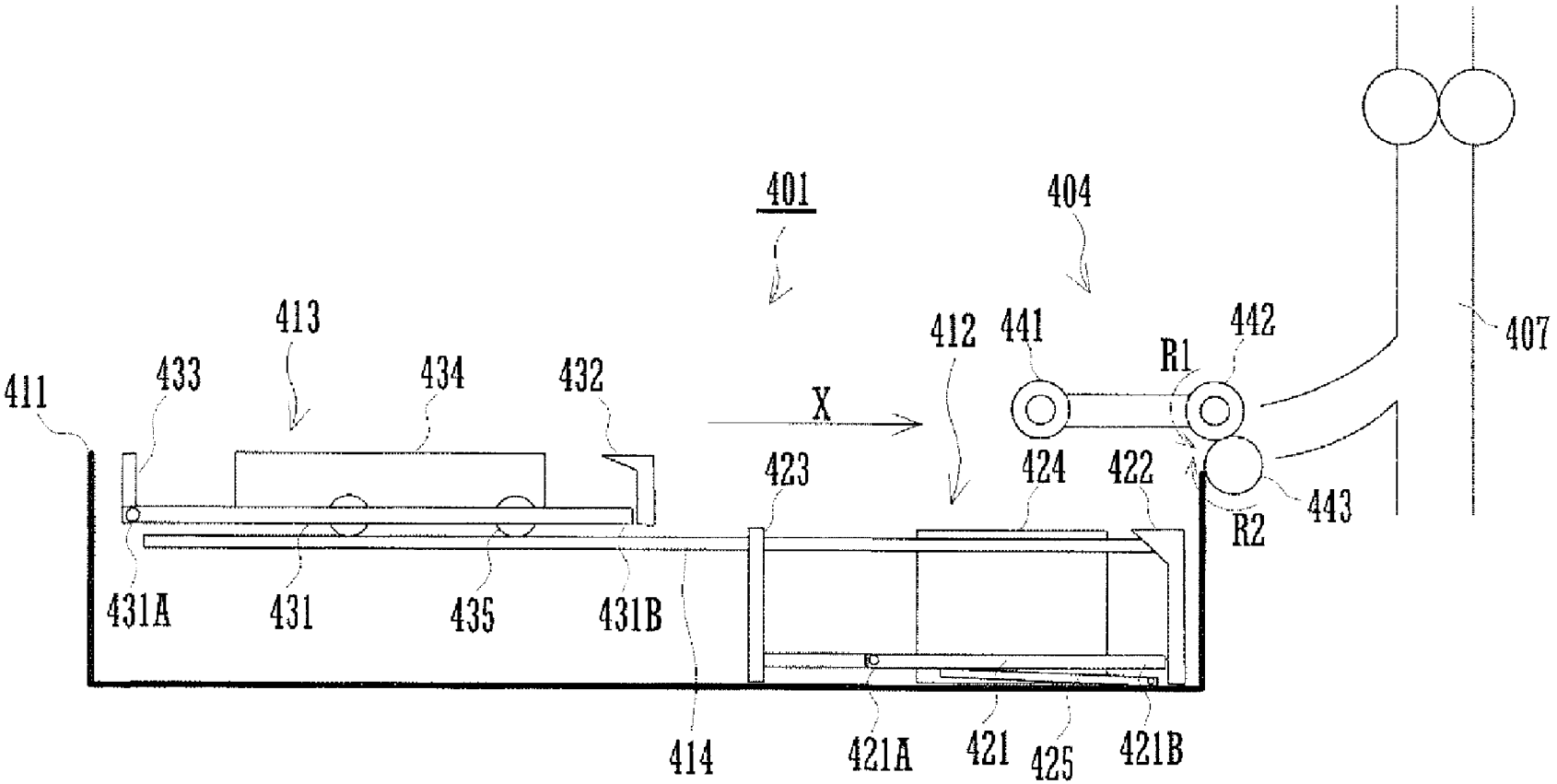
FIG. 2 is a sectional side view of a feed cassette of the image forming apparatus.
Figure 3A:
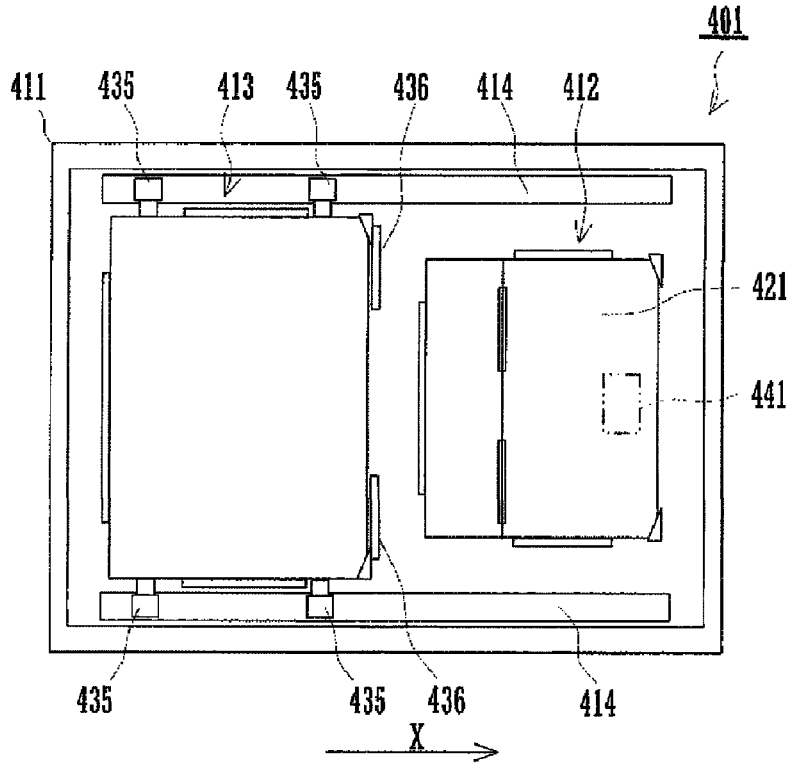
FIG. 3A is a top plan of the feed cassette, showing its movable paper holder being in a retracted position.
Figure 3B:
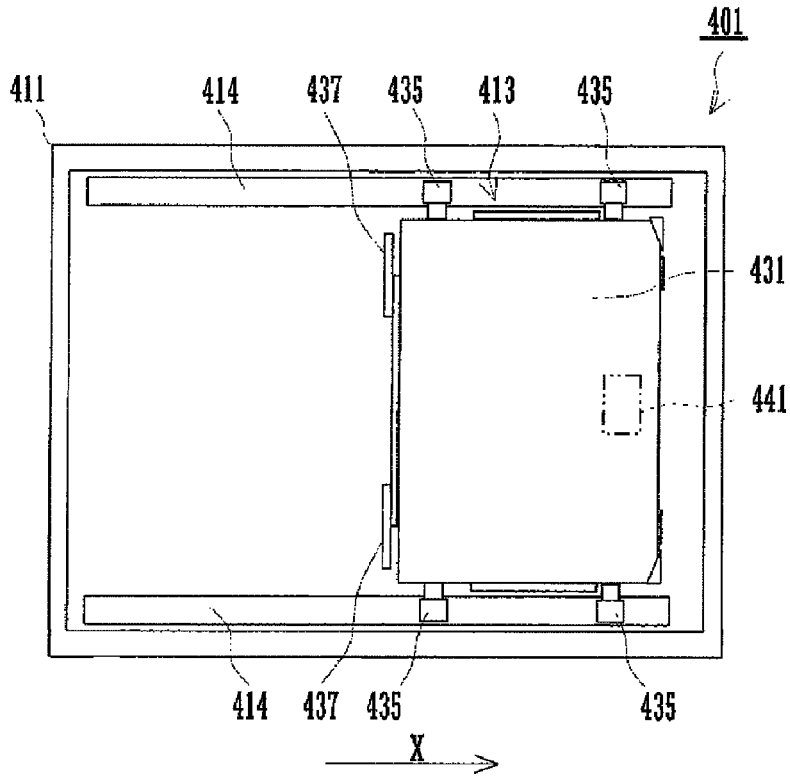
FIG. 3B is a top plan of the feed cassette, showing the movable paper holder being in an exposed position.

With reference to FIGS. 2, 3A, and 3B, the feed cassette 401 includes a box 411 open at its top, a fixed paper holder 412, a movable paper holder 413, and rails 414. The paper holders 412-413 and rails 414 are positioned in the box 411.

The fixed paper holder 412, which corresponds to the first paper holder, is fixed to the bottom of the box 411 and includes a support plate 421, claws 422, a rear plate 423, side plates 424, and a presser 425. The top of this paper holder 412 is open. The support plate 421 supports a pile of sheets of paper on it.

The support plate 421 is so supported pivotably around its rear edge 421A that its front edge 421B can shift upward.

The claws 422 can shift vertically within a preset range and come into contact with corners of the upper side of the top sheet in the fixed paper holder 412 so as to define the highest position of this sheet.

The rear plate 423 stops the sheets in the fixed paper holder 412 from shifting reversely to the direction X in which sheets of paper can be fed. The side plates 424 define the lateral position of the sheets in this paper holder 412.

The presser 425 is supported pivotably around its front end on the bottom of the box 411. The rear end of the presser 425 comes into contact with the under side of the support plate 421. Rotation of a motor M2 (FIG. 4) turns the presser 425 upward, biasing the support plate 421 upward. The presser 425 and motor M2 correspond to the biaser.

The movable paper holder 413, which corresponds to the second paper holder, includes a support plate 431, claws 432, a rear plate 433, side plates 434, and rollers 435. The top of this paper holder 413 is open. The support plate 431 supports a pile of sheets of paper on it.

The support plate 431 is so supported pivotably around its rear edge 431A that its front edge 431B can shift upward.

The claws 432 can shift vertically within a preset range and come into contact with corners of the upper side of the top sheet in the movable paper holder 413 so as to define the highest position of this sheet.

The rear plate 433 stops the sheets in the movable paper holder 413 from shifting reversely to the direction X. The side plates 434 define the lateral position of the sheets in this paper holder 413. The rollers 435 can be rotated by a motor M1 (FIG. 4), which corresponds to the first driving source.

The fixed paper holder 412 hold smaller sheets of paper than the movable paper holder 413. For example, if the maximum size of sheets on which the apparatus 100 can form images is A3, the paper holders 412 and 413 hold sheets of B5 and A4 sizes respectively.

The fixed paper holder 412, which is positioned below the movable paper holder 413, holds more sheets of paper than the holder 413. In view of frequency of use, the paper holders 412 and 413 hold different types of sheets such as regular paper and coated paper for photographic image formation.

The rails 414 extend in the direction X on the inside of the side walls of the box 411. The rollers 435 roll on the rails 414 so as to move the movable paper holder 413 along the rails. The bottom of the movable paper holder 413 is positioned higher than the top sheet in the fixed paper holder 412 so as to be out of contact with the sheets in the fixed paper holder 412 while the movable paper holder 413 is moving. The rollers 435, rails 414, and motor M1 correspond to the shifting mechanism. The shifting mechanism may otherwise include a belt or a wire running between the retracted and exposed positions of the movable paper holder 413.

With reference to FIG. 2, the feed mechanism 404 includes a pickup roller 441, a feed roller 442, and a parting roller 443.

The pickup roller 441 is supported over a single feed position in the box 411 shiftably around the feed roller 442. The peripheral surface of the pickup roller 441 comes into contact with the upper side of the top sheet in one of the paper holders 412 and 413. Rotation of the pickup roller 441 in contact with the top sheet moves this sheet in the direction X. The feed roller 442 can be rotated in the direction R1 by a motor (not shown). The parting roller 443 is supported rotatably through a torque limiter (not shown) and biased against the feed roller 442.

If a sheet of paper is moved to the nip between the feed roller 442 and parting roller 443, a load within the range allowed by the torque limiter acts on the parting roller 443, so that this roller rotates in the direction R2 with the feed roller 442 rotating in the direction R1. If two or more sheets of paper are moved at a time to the roller nip, a load exceeding the allowed range acts on the parting roller 443, so that this roller does not rotate. Likewise, if the pickup roller 441 picks up two or more sheets of paper at a time, only the top sheet is fed through the roller nip to the feed passage 407.

FIGS. 3A and 3B show the movable paper holder 413 being in the retracted and exposed positions respectively in the box 411. The rolling of the rollers 435 on the rails 414 moves this paper holder 413 between these positions.

The fixed paper holder 412 is fixed in the feed position in the box 411, where its support plate 421 is positioned under the pickup roller 441. When the movable paper holder 413 is in the retracted position, as shown in FIG. 3A, the pickup roller 441 moves sheets of paper on the support plate 421 of the fixed paper holder 412 one after one in the direction X. The movable paper holder 413 in this position is locked there by rear stoppers 436. The rear stoppers 436 are fitted on the bottom of the box 411, but might be fitted on another part of the box, and selectively come into contact with the front of the movable paper holder 413.

When the movable paper holder 413 is in the exposed position, as shown in FIG. 3B, this holder is positioned over the fixed paper holder 412, with the pickup roller 441 over the support plate 431 of the movable paper holder 413. With the movable paper holder 413 in this position, the pickup roller 441 moves sheets of paper on the support plate 431 of this holder one after one in the direction X. The movable paper holder 413 in this position is locked there by front stoppers 437. The front stoppers 437, which correspond to the locking mechanism, are fitted on the bottom of the box 411, but might be fitted on another part of the box, and selectively come into contact with the rear of the movable paper holder 413. In place of the front stoppers 437, the rear stoppers 436 could also lock the movable paper holder 413 in the exposed position.

Figure 4:
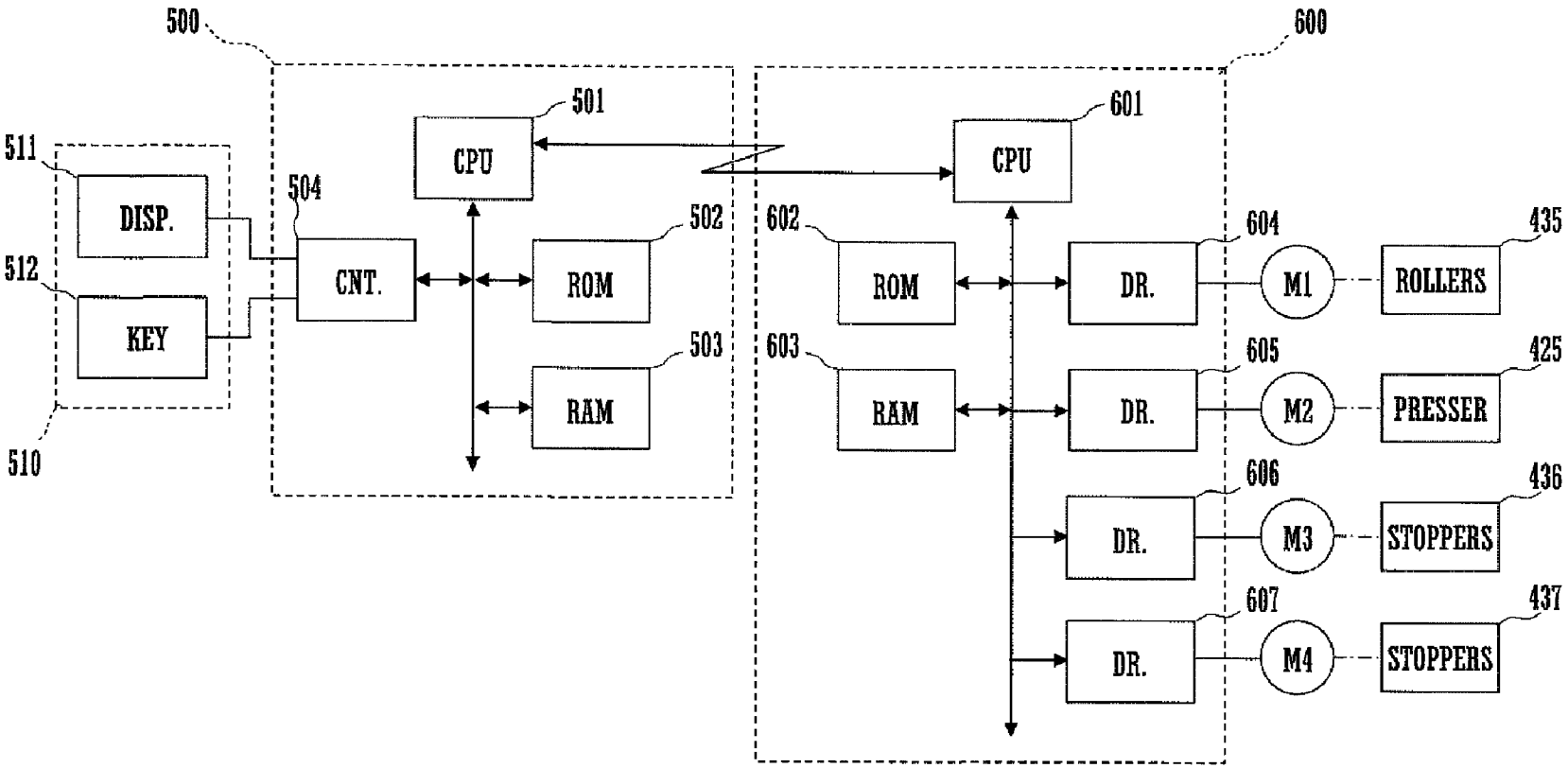
FIG. 4 is a block diagram of the main and auxiliary control stations of the image forming apparatus.

The apparatus 100 includes a main control station 500 as shown in FIG. 4. The control station 500 includes a CPU 501, a ROM 502, a RAM 503, and a controller 504. The CPU 501 is connected to the ROM 502, RAM 503, and controller 504. The ROM 502 stores the program according to which the CPU 501 operates. The RAM 503 stores the data input in and output from the CPU 501. The controller 504 is connected to the display 511 and key switches 512 of a console panel 510.

The console panel 510 is positioned on the top of the apparatus 100. The display 511 shows how the apparatus 100 is operating. The key switches 512 enable the operator to enter operation data on image formation conditions, which include image density, magnification, and paper size.

The operation data entered through the key switches 512 are input to the CPU 501 by the controller 504. Based on the image formation conditions, which are specified by the operation data, the CPU 501 sets the conditions of the image reading station 200, image forming station 300, and paper feeding station 400. The CPU 501 outputs display data to the controller 504, which displays them on the display 511.

The paper feeding station 400 includes an auxiliary control station 600 as shown in FIG. 4. The control station 600 includes a CPU 601, a ROM 602, a RAM 603, and drivers 604-607. The CPU 601 is connected to the ROM 602, RAM 603, and drivers 604-607. The ROM 602 stores the program according to which the CPU 601 operates. The RAM 603 stores the data input in and output from the CPU 601.

Based on the drive data output from the CPU 601, the drivers 604-607 drive motors M1-M4 respectively. The motor M1, which corresponds to the first driving source, is mounted in the movable paper holder 413 and rotates the rollers 435 selectively in either direction. The motor M1 might be replaced by two motors one of which rotates in only one direction and the other of which rotates only in the opposite direction. Rotation of the motor M2 turns the presser 425 upward, biasing the support plate 421 of the fixed paper holder 412 upward. Rotation of the motors M3 and M4 brings the stoppers 436 and 437 respectively into contact with this paper holder 412.

For image formation, the operator enters operation data on image formation conditions, which include a paper type datum, through the key switches 512 into the main control station 500. Then, the CPU 501 of this control station 500 transmits a feed request including the paper type datum to the CPU 601 of the auxiliary control station 600. Based on the paper type datum, the CPU 601 makes the paper feeding station 400 feed the appropriate number of sheets from the appropriate feed cassette 401, 402, or 403. If the paper type datum specifies the sheets held in one of the paper holders 412 and 413 of the cassette 401, the CPU 601 outputs drive data selectively to one or more of the drivers 604-607.

The auxiliary control station 600 might be formed as an integral part of the main control station 500.

Figure 5:
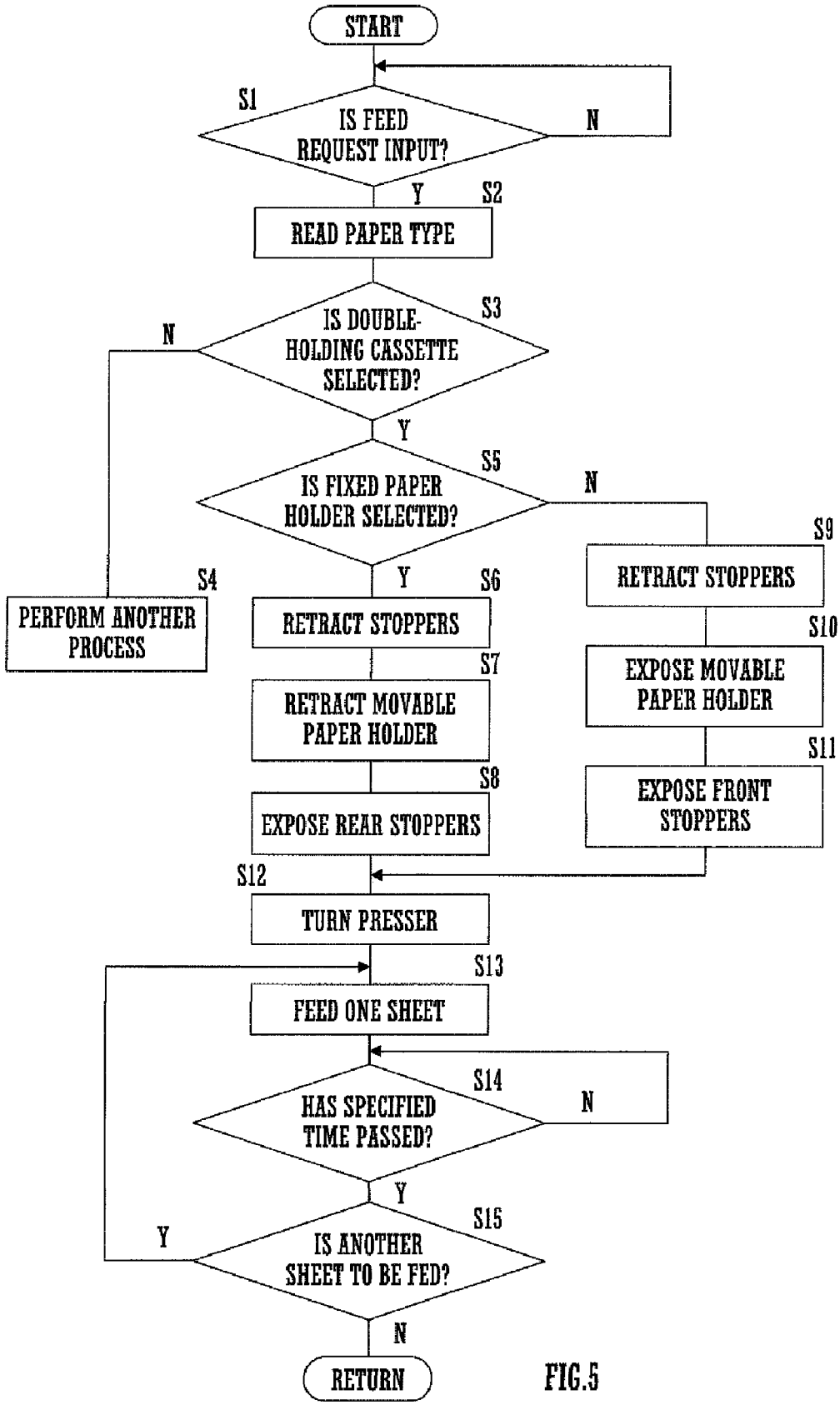
FIG. 5 is a flowchart of the processing performed by the auxiliary control station.

FIG. 5 shows the processing performed by the auxiliary control station 600. After the apparatus 100 is switched on, the CPU 601 of this control station 600 waits for a feed request from the CPU 501 of the main control station 500 (S1). If a feed request from the CPU 501 is input to the CPU 601, the CPU 601 reads the paper type datum of the feed request (S2) and determines whether this datum specifies the sheets in the feed cassette 401, which includes the two paper holders (S3). If the paper type datum specifies the sheets in one of the other cassettes 402 and 403, the CPU 601 executes another step (S4).

If the paper type datum specifies the sheets in the feed cassette 401, the CPU 601 determines whether this datum specifies the sheets in the fixed paper holder 412 or the movable paper holder 413 (S5). If the paper type datum specifies the sheets in the fixed paper holder 412, the CPU 601 makes the motors M3 and M4 rotate to retract the stoppers 436 and 437 respectively (S6). Next, the CPU 601 makes the motor M1 rotate reversely to shift the movable paper holder 413 to the retracted position (S7). Next, the CPU 601 makes the motor M3 rotate to expose the rear stoppers 436, locking the movable paper holder 413 in the retracted position (S8).

If the paper type datum specifies the sheets in the movable paper holder 413, the CPU 601 makes the motors M3 and M4 rotate to retract the stoppers 436 and 437 respectively (S9). Next, the CPU 601 makes the motor M1 rotate in the normal direction, shifting the movable paper holder 413 to the exposed position (S10). Next, the CPU 601 makes the motor M4 rotate to expose the front stopper 437, locking the movable paper holder 413 in the exposed position (S11).

After step S8 or S11, the CPU 601 makes the motor M2 rotate to turn the presser 425 upward, biasing the support plate 421 or 431 upward (S12). Next, the CPU 601 makes the pickup roller 441 shift downward, and makes the feed mechanism 404 feed a sheet of paper from the appropriate paper holder 412 or 413 (S13). When a specified time passes after the sheet is fed (S14), the CPU 601 determines whether another sheet of paper is to be fed from the same paper holder (S15). The CPU 601 repeats steps S13-S15 until the requested number of sheets are fed from the same paper holder.

Figure 6A:
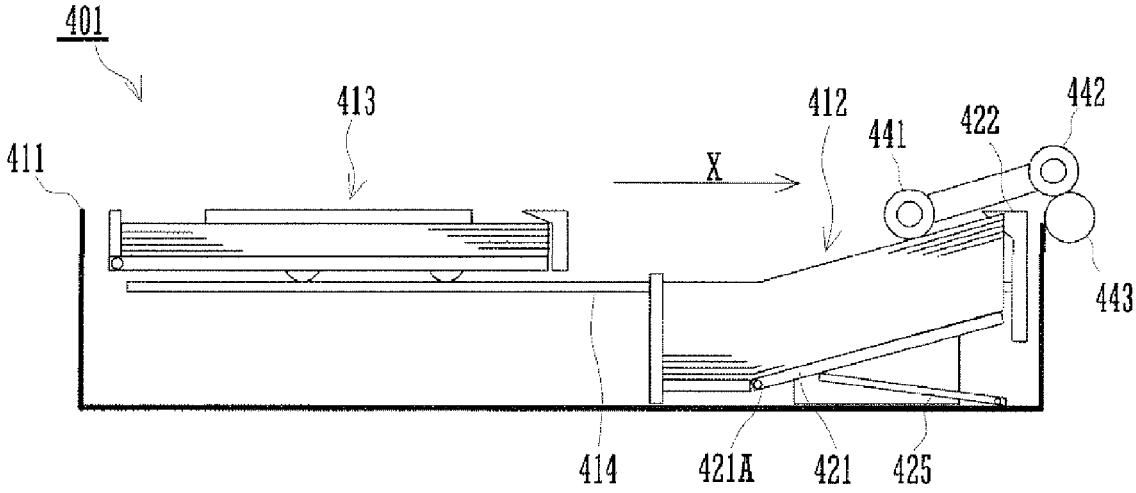
FIG. 6A is a sectional side view of the feed cassette, showing how sheets of paper can be fed from the fixed paper holder.
Figure 6B:
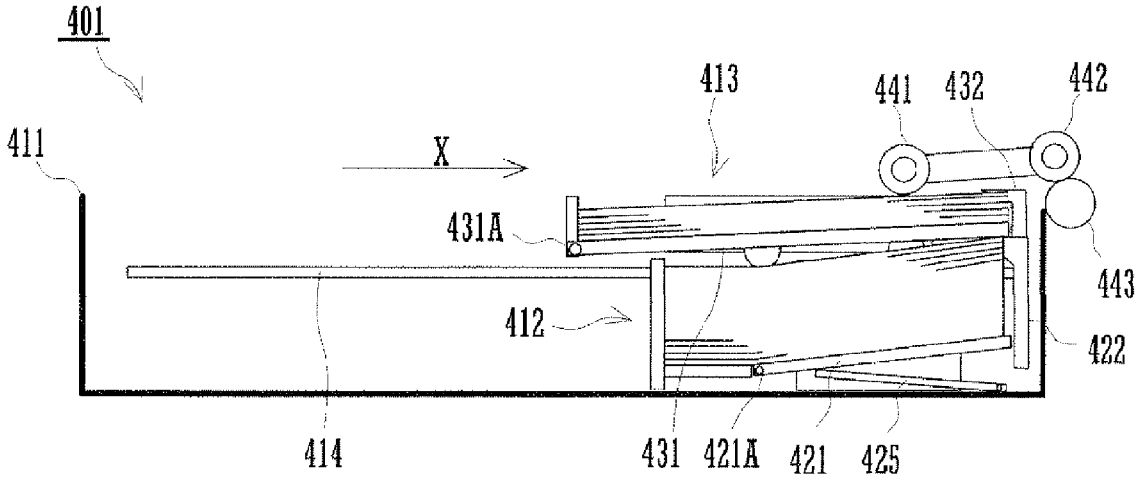
FIG. 6B is a sectional side view of the feed cassette, showing how sheets of paper can be fed from the movable paper holder.

FIGS. 6A and 6B show how sheets of paper are fed from the fixed paper holder 412 and movable paper holder 413 respectively.

For paper feeding from the fixed paper holder 412, the movable paper holder 413 is positioned in the retracted position, as shown in FIG. 6A. With the movable paper holder 413 in the retracted position, clockwise turning of the presser 425 turns the support plate 421 of the fixed paper holder 412 around the rear edge 421A of this plate counterclockwise in FIG. 6A, lifting the front ends of the sheets in the fixed paper holder 412. With these sheet ends lifted, downward shifting of the pickup roller 441 brings its peripheral surface into contact with the top sheet in the fixed paper holder 412. Rotation of the pickup roller 441 in contact with the top sheet moves this sheet in the direction X.

For paper feeding from the movable paper holder 413, this holder is positioned in the exposed position, as shown in FIG. 6B. With the movable paper holder 413 in the exposed position, clockwise turning of the presser 425 turns the support plate 421 of the fixed paper holder 412 around the rear edge 421A of this plate counterclockwise in FIG. 6B, lifting the front ends of the sheets in the fixed paper holder 412. This turns the support plate 431 of the movable paper holder 413 upward around the rear edge 431A of this plate, lifting the front ends of the sheets in the movable paper holder 413. With these sheet ends lifted, downward shifting of the pickup roller 441 brings its peripheral surface into contact with the top sheet in the movable paper holder 413. Rotation of the pickup roller 441 in contact with the top sheet moves this sheet in the direction X.

Thus, the feed mechanism 404 feeds a sheet of paper selectively from one of the paper holders 412 and 413 of the feed cassette 401. The paper feeding station 400 does not need to be fitted with two feed mechanisms for the cassette 401. This simplifies the structure of the apparatus 100. In addition, this prevents complication of the feed passages, keeping the frequency of paper jams on them from increasing.

As stated already, the presser 425 turns the support plate 431 of the movable paper holder 413 upward by turning the support plate 421 of the fixed paper holder 412 upward so as to lift the front ends of the sheets in this holder 412. Alternatively, the movable paper holder 413 might be fitted with an independent presser.

Figure 7A:
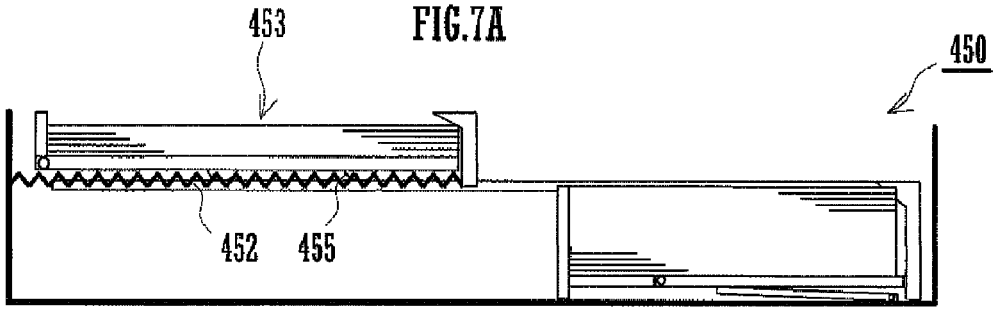
FIGS. 7A-7D are sectional side views of feed cassettes.

FIG. 7A shows a feed cassette 450. The cassette 450 includes a fixed paper holder, a movable paper holder 453, rollers 455, and an elastic member 452. The movable paper holder 453 is supported on the rollers 455 and biased toward the retracted position in the cassette 450 by the elastic member 452. The rollers 455 need to be rotated in only one direction to move this paper holder 453 toward the exposed position in the cassette 450. Therefore, the driving source for the rollers 455 can be a motor which rotates in only one direction.

Alternatively, the feed cassette 450 might include, in place of the elastic member 452, an elastic member biasing the movable paper holder 453 toward the exposed position. In this case, the rollers 455 might be rotated by a motor which rotates in only one direction to move this paper holder 453 toward the retracted position.

Figure 7B:
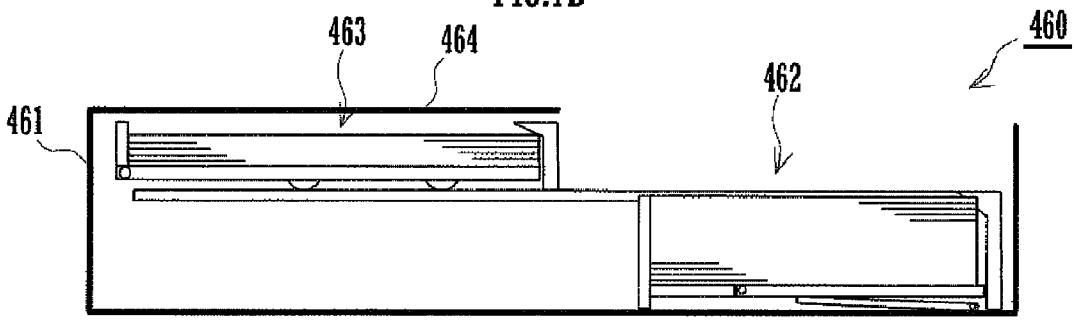

FIG. 7B shows a feed cassette 460. The cassette 460 includes a box 461, a fixed paper holder 462, and a movable paper holder 463. The box 461 has a cover 464 formed at its top, which covers the top of the movable paper holder 463 in the retracted position in the cassette 460. The cassette 460 may be fitted in an image forming apparatus installed in a store or another place where anyone can operate the apparatus, with the movable paper holder 463 holding coated or other expensive sheets of paper. The cover 464 keeps the expensive sheets out of view, preventing them from being stolen.

Even without the cover 464, the sheets in the fixed paper holder 462 could be kept out of view with the movable paper holder 463 positioned in the exposed position. This could prevent the sheets in the fixed paper holder 462 from being stolen.

Figure 7C:
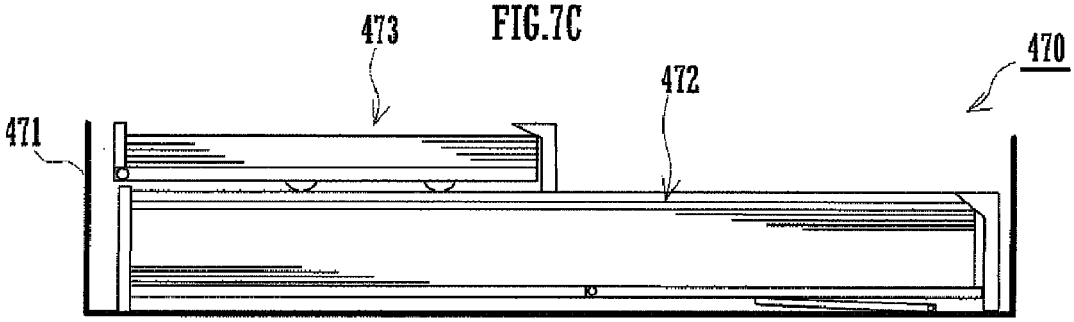

FIG. 7C shows a feed cassette 470. The cassette 470 includes a box 471, a fixed paper holder 472, and a movable paper holder 473. The fixed paper holder 472 is fixed in the box 471 and holds larger sheets of paper than the movable paper holder 473. The space in the box 471 can be efficiently used.

Figure 7D:
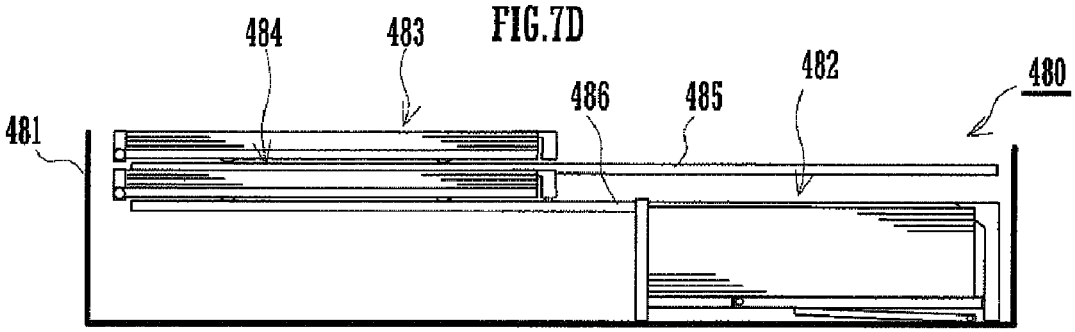

FIG. 7D shows a feed cassette 480. The cassette 480 includes a box 481, a fixed paper holder 482, an upper movable paper holder 483, a lower movable paper holder 484, a pair of upper rails 485, and a pair of lower rails 486. The rails 485 and 486 extend on the inside of the side walls of the box 481 and support the movable paper holders 483 and 484 respectively. Thus, the three paper holders 482, 483, and 484 are fitted in the box 481 and hold three types of paper.

It should be considered that the foregoing description of the embodiments is illustrative in all respects and not restrictive. The scope of the present technology is defined by the appended claims, not by the embodiments, and intended to include meanings equivalent to those of the elements of the claims and all modifications in the claims.

What is claimed is:

1. A feeding device for use with an apparatus, the device being adapted to hold sheets of paper therein, the apparatus including a feed mechanism for feeding a sheet of paper in a feed direction from the device, the apparatus further including a processing station for processing the sheet fed by the feed mechanism, the device comprising:

a box containing the feed mechanism being adapted to feed a sheet of paper in a single feed position in the box through the box top;

a first paper holder positioned in the box for holding a pile of sheets of paper therein;

a second paper holder positioned in the box for holding another pile of sheets of paper therein;

a shifting mechanism for moving the second paper holder between an exposed position over a top sheet held in the first paper holder and a retracted position which is upstream from the exposed position in the feed direction;

linear rails fixed on side walls of the box and extending between the exposed and retracted positions;

rollers supported rotatably by the second paper holder and adapted to roll on the rails;

a first driving source coupled to at least one of the rollers, wherein the driving source causes the at least one roller to selectively rotate in first and second directions to cause the second paper holder to move between the exposed and retracted positions; and a locking mechanism, comprising:

a stopper movably mounted on the box that is movable between an unlocked position and a locked position, wherein when the stopper is in the locked position, the stopper blocks the second paper holder from moving out of the exposed position, and a motor that moves the stopper between the locked and unlocked positions.

2. A feeding device as claimed in claim 1, further comprising an elastic member that biases the second paper holder toward the retracted position.

3. A feeding device for use with an apparatus, the device being adapted to hold sheets of paper therein, the apparatus including a feed mechanism for feeding a sheet of paper in a feed direction from the device, the apparatus further including a processing station for processing the sheet fed by the feed mechanism, the device comprising:

a box containing the feed mechanism being adapted to feed a sheet of paper in a single feed position in the box through the box top;

a first paper holder positioned in the box for holding a pile of sheets of paper therein;

a second paper holder positioned in the box for holding another pile of sheets of paper therein;

a shifting mechanism for moving the second paper holder between an exposed position over a top sheet held in the first paper holder and a retracted position which is upstream from the exposed position in the feed direction;

at least one stopper that is movably mounted on the box and that is movable between an unlocked position and a locked position, wherein when the at least one stopper is in the locked position, the at least one stopper blocks the second paper holder from moving out of either the exposed position or the retracted position; and a motor that moves the at least one stopper between the locked and unlocked positions.

4. A feeding device as claimed in claim 3, further comprising:

a biaser fitted at the bottom of the box;

the first paper holder including a first support plate for supporting the pile of sheets in the first paper holder, the first support plate being so supported that the front edge thereof which is downstream in the feed direction shifts around the rear edge thereof which is upstream in the feed direction;

the first paper holder being so positioned fixedly in the bottom of the box that the top sheet in the first paper holder is positioned in the single feed position;

the biaser being adapted to upward bias the front edge of the first support plate which is downstream in the feed direction;

the second paper holder including a second support plate for supporting the pile of sheets in the second paper holder, the second support plate being so supported that the front edge thereof which is downstream in the feed direction shifts around the rear edge thereof which is upstream in the feed direction.

5. A feeding device as claimed in claim 4, wherein the shifting mechanism includes:

linear rails fixed on the inside of the side walls of the box and extending between the exposed and retracted positions;

rollers supported rotatably by the second paper holder and adapted to roll on the rails; and a first driving source for rotating the rollers selectively in either direction.

6. A feeding device as claimed in claim 4, wherein the sheets in the first paper holder differ in size from the sheets in the second paper holder.

7. A feeding device as claimed in claim 6, wherein the sheets in the first paper holder are longer perpendicularly to the feed direction than the sheets in the second paper holder.

8. A feeding device as claimed in claim 4, wherein the pile of sheets in the first paper holder is higher than the pile of sheets in the second paper holder.

9. The feeding device as claimed in claim 3, wherein the shifting mechanism includes:

linear rails fixed on the inside of the side walls of the box and extending between the exposed and retracted positions;

rollers supported rotatably by the second paper holder and adapted to roll on the rails; and a motor coupled to at least one of the rollers, wherein the motor causes the at least one roller to selectively rotate in first and second directions to cause the second paper holder to move between the exposed and retracted positions.

10. A feeding device as claimed in claim 3, wherein the at least one stopper comprises a front stopper and a rear stopper that are both movable between an unlocked position and a locked position, wherein when the rear stopper is in the locked position, the rear stopper blocks the second paper holder from moving out of the retracted position, and wherein when the front stopper is in the locked position, the front stopper blocks the second paper holder from moving out of the exposed position.

11. A feeding device as claimed in claim 3, further comprising an elastic member biasing the second paper holder toward the retracted position.

12. An image forming apparatus comprising:

a feeding device being adapted to hold sheets of paper therein, the feeding device comprising:

a box containing a feed mechanism being adapted to feed sheets of paper in downward order in a single feed position in the box through the box top;

a first paper holder positioned in the box for holding a pile of sheets of paper therein;

a second paper holder positioned in the box for holding another pile of sheets of paper therein;

a shifting mechanism for moving the second paper holder between an exposed position over a top sheet held in the first paper holder and a retracted position which is upstream from the exposed position in the feed direction;

at least one stopper that is movably mounted on the box and that is movable between an unlocked position and a locked position, wherein when the at least one stopper is in the locked position, the at least one stopper blocks the second paper holder from moving out of either the exposed position or the retracted position; and a motor that moves the at least one stopper between the locked and unlocked positions; and an image forming station for forming images on the sheets fed by the feed mechanism.

13. An image forming apparatus comprising:

a feeding device being adapted to hold sheets of paper therein, the feeding device comprising:

a box containing a feed mechanism being adapted to feed sheets of paper in downward order in a single feed position in the box through the box top;

a first paper holder positioned in the box for holding a pile of sheets of paper therein;

a second paper holder positioned in the box for holding another pile of sheets of paper therein;

a shifting mechanism for moving the second paper holder between an exposed position over a top sheet held in the first paper holder and a retracted position which is upstream from the exposed position in the feed direction;

at least one stopper that is movably mounted on the box and that is movable between an unlocked position and a locked position, wherein when the at least one stopper is in the locked position, the at least one stopper blocks the second paper holder from moving out of either the exposed position or the retracted position;

a motor that moves the at least one stopper between the locked and unlocked positions;

a biaser fitted at the bottom of the box;

the first paper holder including a first support plate for supporting the pile of sheets in the first paper holder, the first support plate being so supported that the front edge thereof which is downstream in the feed direction shifts around the rear edge thereof which is upstream in the feed direction;

the first paper holder being so positioned fixedly in the bottom of the box that the top sheet in the first paper holder is positioned in the single feed position;

the biaser being adapted to upward bias the front edge of the first support plate which is downstream in the feed direction;

the second paper holder including a second support plate for supporting the pile of sheets in the second paper holder, the second support plate being so supported that the front edge thereof which is downstream in the feed direction shifts around the rear edge thereof which is upstream in the feed direction; and an image forming station for forming images on the sheets fed by the feed mechanism.

14. A feeding device for use with an apparatus, the device being adapted to hold sheets of paper therein, the apparatus including a feed mechanism for feeding a sheet of paper in a feed direction from the device, the apparatus further including a processing station for processing the sheet fed by the feed mechanism, the device comprising:

a box containing the feed mechanism being adapted to feed a sheet of paper in a single feed position in the box through the box top;

a first paper holder for holding a pile of sheets of paper therein;

a second paper holder for holding another pile of sheets of paper therein;

the two paper holders being positioned in the box;

a shifting mechanism for shifting the second paper holder between an exposed position over a top sheet held in the first paper holder and a retracted position in the box which is upstream in the feed direction from the exposed position, the exposed position being such that a top sheet in the second paper holder is in the single feed position when the second paper holder is in the exposed position, wherein the top sheet in one of the paper holders is positioned in the single feed position according to selection data output from the apparatus, the shifting mechanism including:

linear rails fixed on the inside of the side walls of the box and extending between the exposed and retracted positions, rollers supported rotatably by the second paper holder and adapted to roll on the rails, and a first driving source for rotating the rollers selectively in either direction;

an elastic member biasing the second paper holder toward the retracted position;

a biaser fitted at the bottom of the box;

the first paper holder including a first support plate for supporting the pile of sheets in the first paper holder, the first support plate being so supported that the front edge thereof which is downstream in the feed direction shifts around the rear edge thereof which is upstream in the feed direction;

the first paper holder being so positioned fixedly in the bottom of the box that the top sheet in the first paper holder is positioned in the single feed position;

the biaser being adapted to upward bias the front edge of the first support plate which is downstream in the feed direction;

the second paper holder including a second support plate for supporting the pile of sheets in the second paper holder, the second support plate being so supported that the front edge thereof which is downstream in the feed direction shifts around the rear edge thereof which is upstream in the feed direction;

a locking mechanism for selectively locking the second paper holder in the exposed position, wherein the locking mechanism comprises:

a front stopper that is movable between an unlocked position and a locked position, wherein when the stopper is in the locked position, the stopper blocks the second paper holder from moving out of the exposed position, and a rear stopper that is movable between an unlocked position and a locked position, wherein when the rear stopper is in the locked position, the rear stopper blocks the second paper holder from moving out of the retracted position.

* * * * *